United States Patent [19]

Ho

[11] 4,009,566

[45] Mar. 1, 1977

[54] DIGITAL WATCH WITH LIQUID CRYSTAL AND SEQUENTIALLY READ OUT LIGHT EMITTING DIODE DISPLAYS

[75] Inventor: Ernest C. Ho, Newport Beach, Calif.

[73] Assignee: Hughes Aircraft Company, Culver City, Calif.

[22] Filed: May 27, 1975

[21] Appl. No.: 581,075

[52] U.S. Cl. ..... 58/50 R; 340/336

[51] Int. Cl.[2] ..... G04B 19/34

[58] Field of Search ..... 58/23 R, 23 BA, 50 R; 340/336

[56] References Cited

UNITED STATES PATENTS

| | | | |
|---|---|---|---|
| 3,576,099 | 4/1971 | Walton | 58/23 R X |
| 3,668,861 | 6/1972 | Mitsui | 58/50 R |
| 3,747,322 | 7/1973 | Eckenrode | 58/50 R |
| 3,765,163 | 10/1973 | Levine et al. | 58/50 R |
| 3,911,665 | 10/1975 | van Berkum | 58/58 X |

OTHER PUBLICATIONS

M. S. Robbins, "Monodigichron," Popular Electronics, Sept. 1973, pp. 35–39.

*Primary Examiner*—Ulysses Weldon
*Attorney, Agent, or Firm*—Fay I. Konzem; W. H. MacAllister

[57] ABSTRACT

A digital watch display system with a dual display element is provided, a liquid crystal for use in daylight, or bright light, and a light emitting diode for use in dim light. The light emitting diode display causes an over drain on the battery used for the watch. In order to minimize this, instead of the usual four digit LED display, two for hours and two for minutes, only two LED display digits are used and are alternately turned on to display hours and minutes.

5 Claims, 6 Drawing Figures

| DO | DH | Display |
|---|---|---|
| 0 | X | Blank |
| 1 | 1 | Hours |
| 1 | 0 | Minutes |

X = Don't Care

DIGITAL WATCH WITH LIQUID CRYSTAL AND SEQUENTIALLY READ OUT LIGHT EMITTING DIODE DISPLAYS

BACKGROUND OF THE INVENTION

1. Field of the Invention

This invention relates to digital electronic watches and more particularly to a digital watch having both a liquid crystal (LCD) and a light emitting diode (LED) display, and more particularly to improvements therein.

2. Description of Prior ARt

Digital electronic watches are being produced and sold having either LED or LCD displays. The LCD display suffers from the drawback that it is difficult to read in dim light, and since the display is based on light being reflected by liquid crystals it is not readable at all in the dark. On the other hand, LED displays are readable in low light levels or in the dark since they are light emitting, but they are difficult to read in high light levels. Also, they constitute a large drain on a battery and that is why they are not left on continuously, but a push button is provided on a digital electronic watch which must be activated each time a horological display is desired.

OBJECTS AND SUMMARY OF THE INVENTION

It is an object of this invention to provide a digital watch with a light emitting diode display which conserves battery power.

It is another object of this invention to provide an LCD digital watch which enables continuous display of horological information.

Yet another object of this invention is the provision of a novel and improved arrangement for providing an LED horological display.

These and other objects of the invention are achieved in an arrangement in a digital watch for displaying hours and minutes using an LED display, where instead of using four LED's for displaying hours and minutes as has been done before, only two LED displays are used. These are alternately actuated for display purposes. This is achieved by enabling power to be applied to the digit drivers of the two LED's, first during an interval when only hour representative signals are received, then during an interval when only minute representative signals are received. Further, upon actuating the button which enables the display to occur, an interval of time, e.g. 1½ seconds, elapses before the display sequence commences, an equal interval for each of the hour and minute displays is permitted to occur, and there is also a time interval between the hour and minute displays. Thus confusion as to which of the displays is minutes and which hours is avoided.

DETAILED DESCRIPTION

Figure 1:
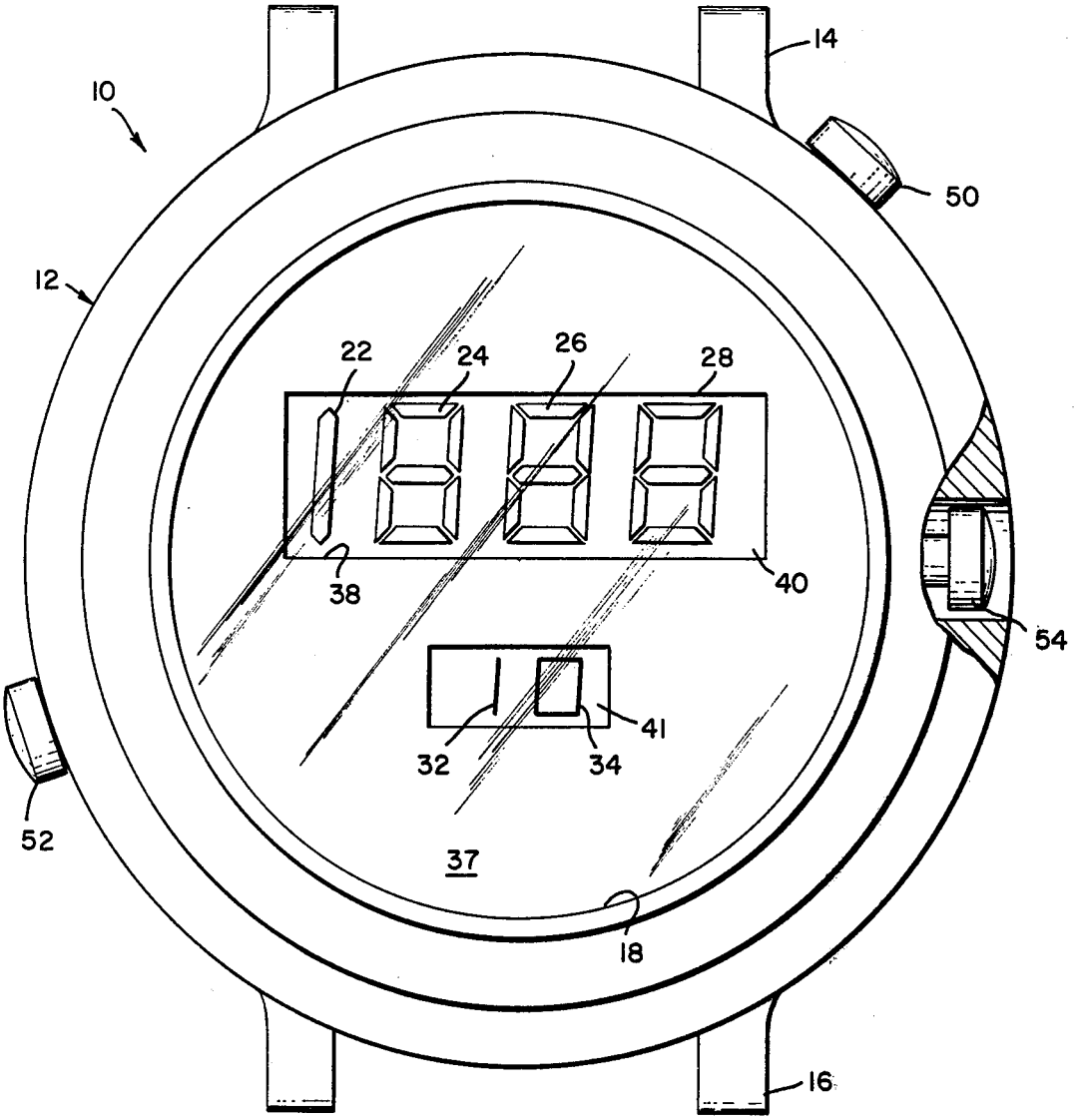
FIG. 1 is a top view of a digital watch with an LCD and an LED display.

Referring now to FIG. 1, the digital watch 10 includes selective electronic circuitry and liquid crystal and LED displays. Digital watch 10 has a case 12 which is provided with watch strap-securing ears 14 and 16. The securing ears 14 and 16 are of such nature that the usual watch strap can be attached thereon so that watch 10 can be carried upon the wrist of the wearer. In the preferred embodiment, the watch 10 is thus a wristwatch, although the same construction, circuitry, and display can be employed in a pocket watch. Compact size batteries (not shown) are mounted on the back of the watch to supply power to the electronic circuitry. Crystal 18 is mounted on the front of the watch case 12. Crystal 18 can be of any color filter to enhance the contrast of the liquid crystal and the LED displays. Through the crystal can be seen a mask 37 which has a display-viewing window 38 therein. Viewed through this display-viewing window 38 is liquid crystal module 40 which contains liquid crystal devices 22, 24, 26, and 28.

Th digital watch of this invention utilizes a 3½ or 4-digit liquid crystal display which remains on continuously, displaying hours and minutes, (in the preferred embodiment) except when commanded by a push button or combination of push buttons. When it is desired to display either the date of the month, the month and date, or the seconds, the hours-minutes display is blanked out and the date, month, or seconds is selectively displayed by selectively actuating push buttons.

The liquid crystal display devices 24, 26, and 28 are each a standard 7-segment liquid crystal display, so that, when the selected segments are energized, the 10 digits 0–9 can be represented accordingly. Display device 22 displays a numeral one, which is only activated during the 10th, 11th, and 12th hours.

The digital watch of this invention also employs a 2-digit LED display, positioned directly below the liquid crystal display. the LED display devices 32 and 34 are each a standard 7-segment display, which when energized, selectively represent the 10 digits from 0–9. The two LED displays are activated by means of manually operated push button 50. LED display elements show the hours information first and then flash the minutes information when push button 50 is depressed. If desired, additional push buttons may be used to display the seconds or the date on the LED's.

Watchcase 12 carries a first manually operable push button control 50 and a second manually operable pushbutton control 52, which are easily accessible. Furthermore, case 12 carries recessed push button control 54 which can be depressed by a pointed object for the purpose of setting the clock by affecting the horological data appearing at the display. In accordance with the functional requirements, more or less push buttons can be employed for the purpose of controlling the watch. The physical structure of the watch module substrate 41 is not visible in the liquid crystal display window, but is visible in the LED display window. The physical structure of the substrates upon which the display devices are mounted and the relationship of the push button controls 52 and 54 to the substrates and to the circuit are disclosed in detail in I. B. Merles and R. F. Zurcher application Ser. No. 343,319, filed Mar. 21, 1973, now U.S. Pat. No.

3,838,568, issued Oct. 1, 1974. The subject of this cross-reference is incorporated herein in its entirety. Said patent application is assigned to the same assignee as the present patent application, Hughes Aircraft Company.

Figure 2:
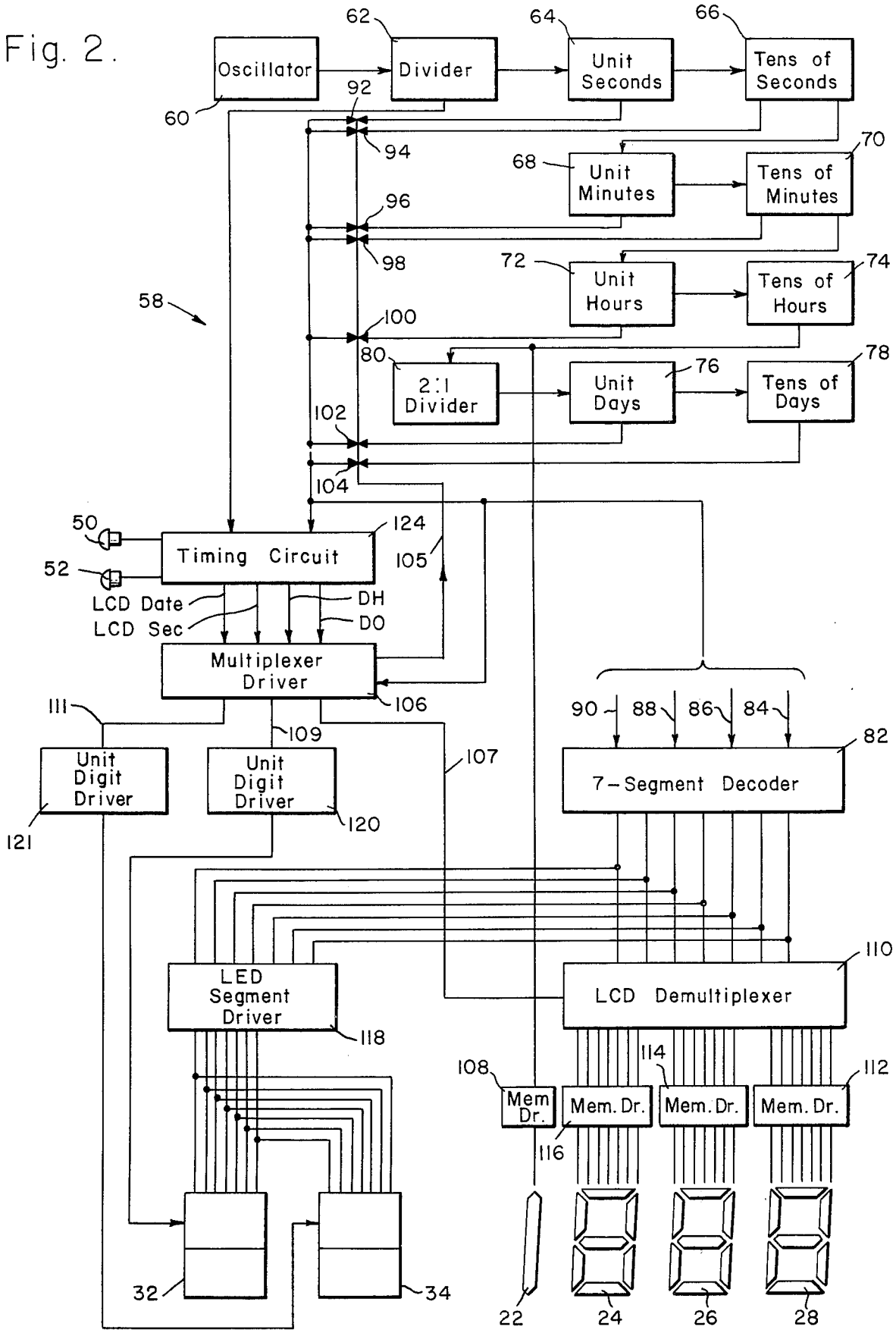
FIG. 2 is a block diagram of the circuitry of the digital watch of this invention.

An electronic circuit 58 employed in the digital watch of FIG. 1 is depicted in FIG. 2. Said circuit consists of an electronic oscillator 60 which is crystal-controlled to socillate at a predetermined and substantially constant frequency. It, as well as the other circuits of this invention, are powered by two compact size batteries mounted on the bottom of the watch so that the entire structure can be mounted in a wristwatch or similar device. Several or all of the subcircuits can be and preferably are contained on the same CMOS circuit chip to minimize assembly labor and chances of misassembly, minimize size, and provide a watch of maximum reliability. The output from the crystal controlled oscillator 60 is driven into a standard CMOS divider 62 which results in an output pulse of one cycle per second. This one Hertz pulse is then driven into the unit seconds counter 64, which is a standard CMOS decode counter, which counts up to 10 (0–9). The unit second counter in turn drives the CMOS tens-of-seconds counter 66 which must count up to six (0–5) to satisfy the requirement of 60 seconds per minute. All successive counters are designed so that at the end of each counter's normal count sequence a pulse is sent to the next counter in the sequence. This counter sequence can be thought as of a consecutive chain of dividers from which various points in the divider chain may be tapped to produce the desired seconds, minutes, hours, and date outputs. All outputs taken from the counters are standard 1, 2, 4, 8, (4 bit) binary coded decimal. Similar to the unit seconds counter's operation, the tens-of-seconds counter 66 drives the unit minutes counter 68, which is a decode counter. The unit minutes counter 68 then drives the tens-of-minutes counter 70, which counts up to six. The tens-of-minutes counter 70 then drives the unit hours counter 72, which is a decode counter. Continuing the chain of divide counters, the unit hours counter 72 then drives the tens-of-hours counter 74.

The present disclosure contemplates a twelve-hour watch. Therefore, the tens-of-hours counter controls the tens-of-hours "number 1" display device 22, and does not need to count beyond that logic state. It is a special counter which is controlled by the unit-hours counter 72 to illuminate the tens-of-hours display device 22 for the 10th, 11th, and 12th hours. Thereupon, it resets. Similarly, it is interconnected with the unit-hours counter 72 so that, when the tens-of-hours counter 74 resets at the end of the 12th hour, the unit-hours counter 72 does not reset to zero, but resets to 1. Thus, there is mutual intercontrol between counters 72 and 74.

The output signal from tens-of-hours counter 74 occurs twice a day. This output is connected through divider 80 to the input of unit-days counter 76. Therefore, the unit-days counter 76 advances only once per day.

Divider 80 stores the information as to whether or not it is ante-meridian or post-meridian.

Unit-days counter 76 thus receives a signal every day and emits a signal every ten days. Tens-of-days register counter 78 need only reach 3, and thus does not need all of the binary coded decimal circuits to make it sufficiently complete to perform the other tasks. Tens-of-days counter 78 is linked to unit-days counter 76 so that, when the total attempts to pass 31 days, counter 78 resets to zero and counter 76 resets to one. It should be noted that tens-of-hours counter 74 and tens-of-days counter 78 do not need a zero signal output. When they are set at zero, no output to the display devices is required.

Seven-segment decoder 82 is a device which receives binary coded decimal signals from the counters and emits seven signals which correspond to the seven segments of the liquid crystal and the LED display devices so that, when turned on to be visibly distinctive, the segments represent the digit corresponding to the counter state. Since it is desired to display different horological information, it is necessary to switch different counters into the input of the 7-segment decoder. For convenience a single 7-segment decoder 82 is employed, and the inputs and outputs therefrom are multiplexed.

There are four input buses 84, 86, 88, and 90 to the seven-segment decoder, each of these buses represent four lines which carry the binary coded decimal information from the counters. Transmission gates 92, 94, 96, and 98, respectively connect counters 64, 66, 68, and 70 to buses 84, 86, 88, and 90. Similarly, transmission gates 100, 102, and 104 respectively connect counters 72, 76, and 78 to buses 84, 86, 88, and 90. The gates are all connected to multiplex driver 106 by line 105.

Multiplex driver 106 has three outputs, line 105, line 107, and line 109. Line 107 controls the liquid crystal displays 24, 26, and 28. Under normal operating conditions, the multiplex driver 106, in combination with decoder 82, operates in such a manner that its output, line 105, delivers clock pulses to the transmission gates so that the information from the counters is delivered to decoder 82. The multiplexer sequentially delivers signals corresponding to unit-minutes to be displayed on liquid crystal device 28, tens-of-minutes to be displayed on device 26, unit-hours on device 24. The tens-of-hours is directly delivered from tens-of-hours counter 74 to display device 22.

Multiplexer 106 and transmission gates 92–104 function as a conventional multiplexer. Multiplexer 106 generates its own clock; i.e., it has an internal clock within it. When a high clock pulse via line 105 and a particular push button either 50 or 52 or both are depressed the appropriate transmission gates are opened enabling the particular set of information present at the respective counters to be delivered through seven-segment decoder 82 and liquid crystal display demultiplexer 110 to the respective display devices. More specifically, when push button 52 is depressed, and when a high binary level signal or clock pulse is generated by multiplexer 106, transmission gates 102 and 104 allow the information from the unit days counter 76 and the tens-of-days counter 78 to be delivered via buss lines 84–90 through the decoder 82 and the liquid crystal display demultiplexer 110 to the appropriate display devices.

Multiplexer driver 106 also controls which display devices 24, 26 or 28 the digital information from the various counters will go to. When push buttons 50 and 52 are unactuated (not depressed) the clock pulses from the multiplexer 106 sequentially open transmission gates 94, 96 and 98 so that the information at unit minutes counter 68, tens-of-minutes counter 70, and units hours counter 72 is delivered through decoder 82 and liquid crystal display demultiplexer 110.

Line 107 from multiplexer driver 106 actually represents 3 lines. The signal on line 107 corresponds to the signal on line 105. When the signal to transmission gate 96 is high, a signal via line 107 to memory driver 112 is also high, thereby allowing the unit minutes information to be delivered to display device 28. Likewise, when the signal via line 105 is high at transmission gate 98 the signal via line 107 to memory driver 114 is high, thereby allowing the tens-of-minutes information to be delivered to display device 26. The output of 7-segment decoder 82 represents the energization of the necessary lines for the seven segments to be displayed in device 28. However, the output from the seven-segment decoder 82, which is going to the liquid crystal displays must be demultiplexed to drive the continuous current liquid crystal display. The demultiplexer 110 has as its input the 7-segment lines and digit select information from driver 106, via line 107. The demultiplexer 110 has as its output 7-segment lines for each of the devices 24, 26, and 28. Memory-drivers 112, 114, and 116 are connected in these lines between the demultiplexer and respectively the devices 28, 26, and 24. Demultiplexer 110 is controlled by multiplex driver 106 so that the seven-segment decoder information is properly distributed to the memory-driver devices. The memory-drivers continuously energize selected segments.

When a different display is desired, push button 50, for example, is depressed. Push button control 52 controls multiplex driver 106 so that the unit-days and tens-of-days counters 76 and 78 are scanned, instead of the minutes and hours counters. In this case, the days stored in these counters are displayed on either or both displays. It is preferable to display the unit-days and tens-of-days on devices 28 and 26, respectively, when a 3½ digit display is employed, as in the preferred embodiment shown. Thus, the minutes and hours are not displayed while push button control 52 is depressed, but the days recorded in the days counters are displayed. Similarly, if display of the seconds is desired, depressing push button controls 50 and 52 simultaneously will activate multiplex driver 106 so that the unit-seconds and tens-of-seconds information stored in counters 64 and 66 are scanned in BCD form and are displayed in devices 28 and 26 in 7-segment form. Furthermore, if additional counters were incorporated, by simple extrapolation from the disclosed counters, the month could be displayed with the day's date. Furthermore, with the use of another push button or combination of push buttons and appropriate counters, other horological information such as the year could be displayed in similar manner.

In operation when push button controls 50 and 52 are unactuated, the multiplex driver 106, via line 105, sequentially opens transmission gates 96, 98, and 100, allowing the information from unit minutes counter 68, tens-of-minutes counter 70, and unit hours counter 72, respectively, to be delivered to the 7-segment decoder 82 through the demultiplexer 110 through their respective memory drivers and finally to be displayed on liquid crystal elements 28, 26, and 24, respectively.

The output from 7-segment decoder 82 must be demultiplexed to drive the continuous current liquid crystal displays 28, 26, and 24. Memory drivers 112, 114, and 116 continuously energize liquid crystal display elements 28, 26, and 24, respectively. Even when a transmission gate is closed, thereby impeding information from that counter to its display element, the memory driver for that display element will maintain the previous information received from the counter when that counter's transmission gate was last opened.

When push button 50 is depressed, multiplex driver 106 sequentially delivers a binary level signal to open transmission gates 96, 98, and 100, the information from unit minutes counter 68, tens-of-minutes counter 70 and unit hours counter 72 is respectively delivered through decoder 82 to the LED segment driver 118 and finally is displayed on LED display elements 32 and 34. First the hours information and then the minutes information are displayed on LED elements 32 and 34. Outputs 109 and 111 from multiplex driver 106 determine which LED display element will receive the information from the 7-segment decoder 82.

The output of multiplex driver 106, line 109, controls the operation of the LED displays 32 and 34. Under normal operating conditions, line 109 does not deliver any horological information to the LED displays. But when push button control 50 is depressed, line 105 supply multiplex clock signals so that the transmission gates scan the minutes and hours data and transmit them in multiplex to decoder 82 which in turn delivers unit-minutes through LED segment driver 118 to be displayed on LED devices 32 and 34. The LED displays are usually employed when the hours and minutes are desired to be viewed in dim light. If desired, additional push buttons may be used to display the seconds or the date on the LED's. Push button control 54 is employed with push button controls 50 and 52 for setting the counters so that the counters carry current time.

The information out of demultiplexer 110 is in the form of seven-segment information. However, since the demultiplexer is a switching device, a memory-driver is necessary for each of the segment lines to provide continuous power to each of the segments to be illuminated.

Liquid crystal memory segment drivers 112, 114, and 116 provide continuous power to liquid crystal display devices 28, 26 and 24, respectively. Liquid crystal digit driver 108 inputs data from the tens-of-hours counter 74. Driver 108 outputs continuous power to liquid crystal display devices 22.

Liquid crystal display devices 22, 24, 26, and 28 are of conventional construction. The liquid crystal cell structure is a sandwich module 40. It is connected directly to the metalization circuit on the substrate which in turn is directly connected to the integrated circuit chips. The electrodes are thus integral with the printed circuitry on the substrate and they are thus directly connected to the chips. A nematic liquid is preferred as the controlling medium for the liquid crystal display. *Liquid crystals* are discussed in further detail in M. Braunstein and W. P. Bleha U.S. Pat. No. 3,732,429 and in T. D. Beard and W. P. Bleha U.S. Pat. No. 3,744,879. The details of the *electronic circuitry* are disclosed in more detail in Hans G. Dill U.S. Pat. No. 3,757,510. Also see my patent application Ser. No. 558,183 on LCD/LED watches. The subject matter of all outside disclosures referenced in this specification are incorporated herein in their entirety by this reference.

The output from the seven-segment decoder 82, which is going to the LED displays must be amplified. LED segment driver 118 has as its input the seven-segment lines and digit select information from ultiplex driver 106, via lines 109 and 111. LED segment driver 118 amplifies these inputs and outputs seven-segment lines for each of the LED devices 32 and 34.

Figure 3:
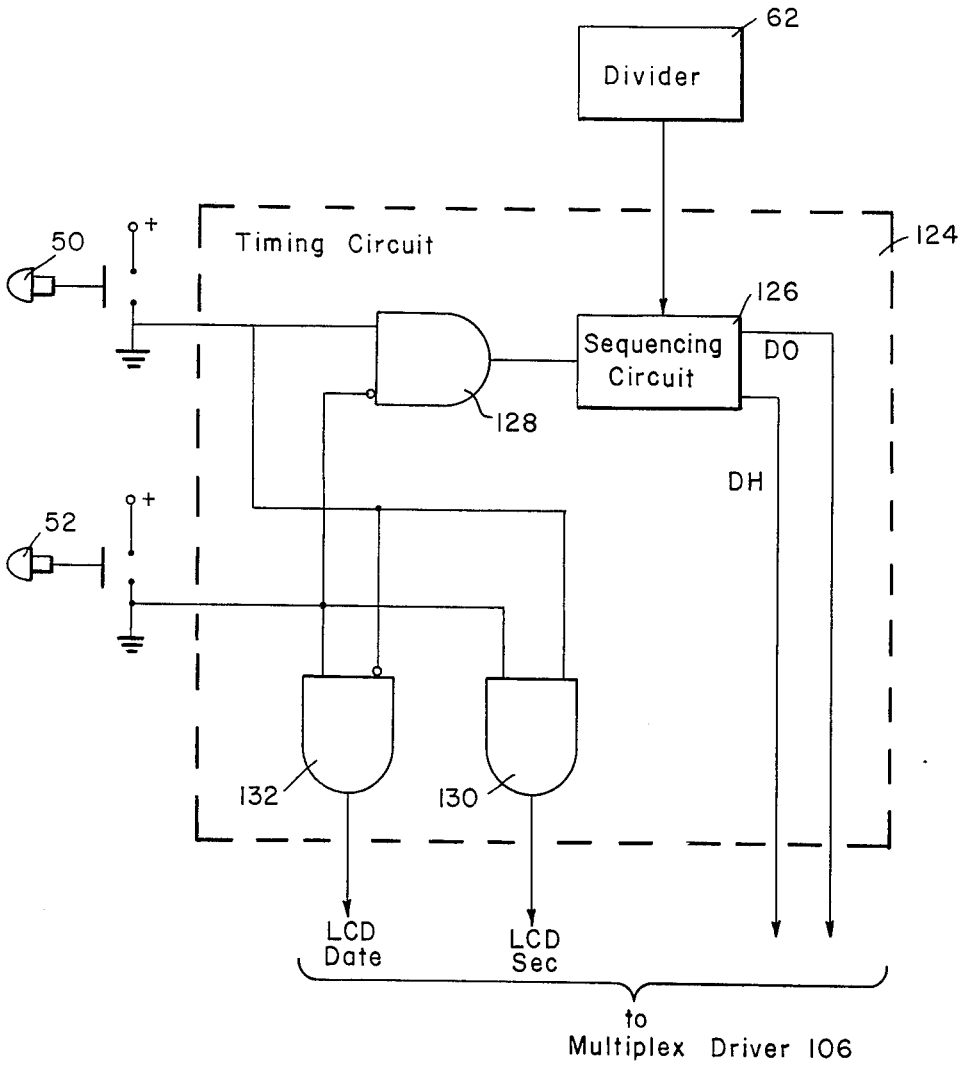
FIG. 3 is a logic diagram of the digital timing circuit of the present invention.

FIG. 3 shows the digital timing circuit 124. When push button control 50 is depressed, high binary level signals are sent to the inputs of AND gate 128, thereby delivering a high signal to activate sequencing circuit 126.

When push button control 52 is depressed, a high binary level signal is delivered to the inputs of AND gate 132, thereby causing the output of gate 132 to deliver a high signal to multiplex driver 106 and to eventually display the date on the LCD elements.

And when push button controls 50 and 52 are both depressed, high binary level signals are delivered to AND gate 130, causing the seconds information to be displayed on the LCD elements.

Normally, the display elements 32 and 34 are blank, until the digital timing circuit 124 of the present invention is activated by the depression of push button control 50. Said timing circuit receives an input signal of 4 Hertz from the divider 62. Timing circuit 124 has four outputs, DO (Display On), DH (Display Hours), LCD date, and LCD seconds. When the binary level of DH is at a high level, the multiplex driver 106 alternately opens transmission gate 100 and thus delivers the unit hours and tens-of-hours information to the 7-segment decoder 82. Decoder 82 in turn receives the BCD signals from said counters and emits seven signals which correspond to the seven segments of the LED display devices. The seven signals are then delivered to the LED segment driver 118 which finally displays said signals on LED display elements 32 and 34. Multiplexer driver 106 also delivers signals to the LED digit drivers 120 and 121 which causes the unit hours information to be displayed on display element 32 and the tens-of-hours information to be displayed on element 34.

When the DO output from timing circuit 124 is at a low binary level the LED display elements are blank.

Finally, when the DH output is at a low binary level, the multiplexer driver 106 alternately opens transmission gate sets 96 and 98 and allows the information from unit minutes counter 68 and tens-of-minutes counter 70 to be delivered to seven-segment decoder 82 which in turn delivers said information in the form of seven signals which correspond to the seven segments of the LED display to the LED segment driver 118. Multiplexer driver 106 also delivers signals to the LED digit drivers 120 and 121 which causes the unit minutes information to be displayed on LED element 32 and the tens-of-minutes information to be displayed on LED display element 34.

Thus, when push button control 50 is depressed, the timing circuit 124 delivers first the hour information to be displayed on the two LED's 32 and 34 for an interval of time, e.g. 1½ sec., the display is then blanked for an interval of time, e.g. 1½ sec., and then the minutes information is delivered to LED segment driver 118, which in turn displays the information on the LED's for an interval of time, e.g. 1½ sec., and finally the display goes blank again.

Figure 4:
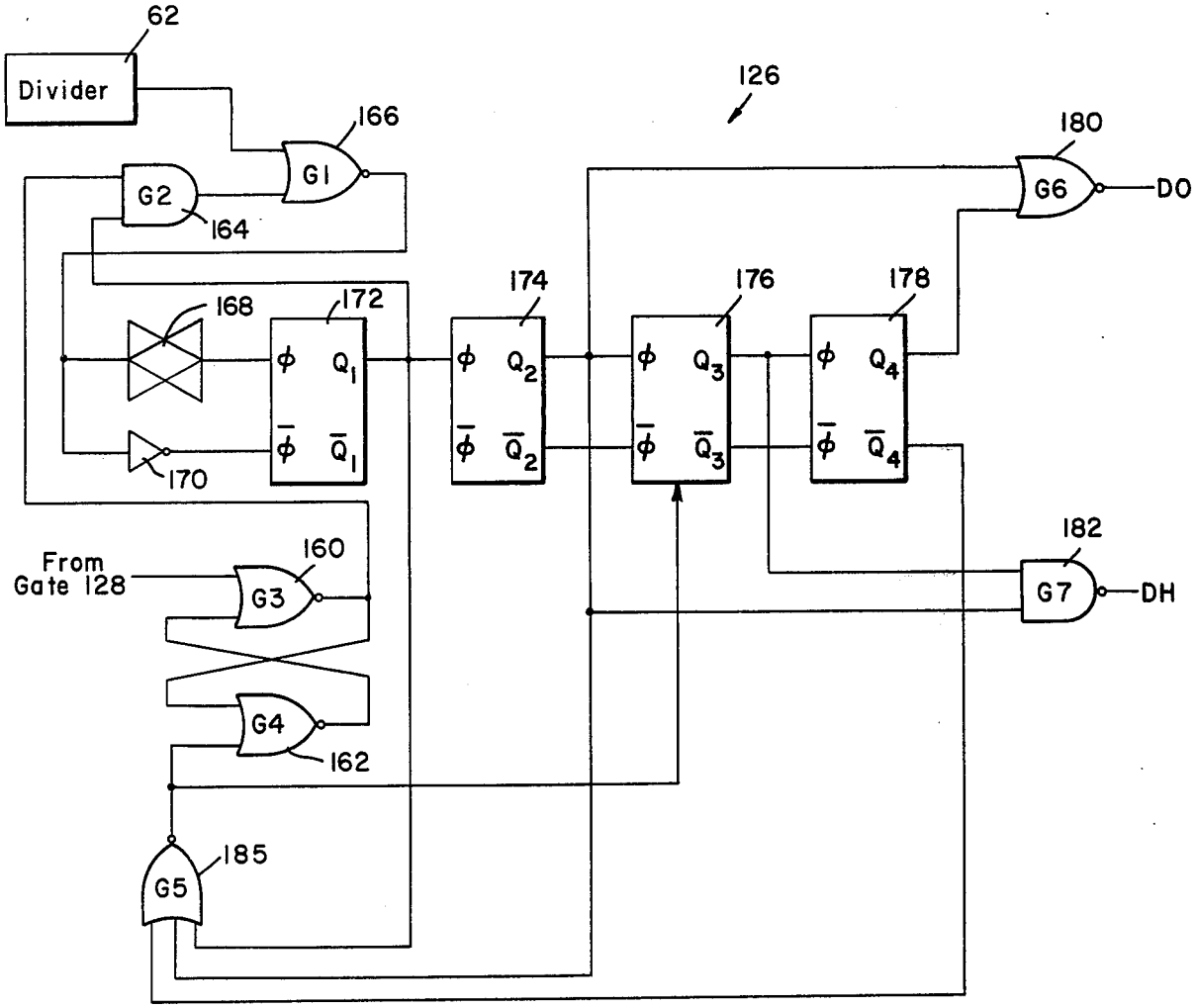
FIG. 4 is a logic diagram of the time sequencing circuit within the timing circuit.

Referring now to FIG. 4, the sequencing circuit 126 consists of NOR gate 160, whose first input is connected to the output of AND gate 128. The second input to NOR gate 160 is connected to the output of NOR gate 162. The output of said gate 160 is connected to a first input to NOR gate 162 and to a first input to AND gate 164. Th output from said AND gate is connected to a first input to NOR gate 166. The second input to NOR gate 166 is connected to a narrow negative 4-Hertz pulse from divider 62 of FIG. 4. More time is allowed to release the push button 50 if the 4-Hertz has a high duty cycle and switch bounce effects are eliminated. The output of NOR gate 166 is, in turn, connected to transmission gate 168 and to inverter gate 170, which forms a two phase clock generator. The output of transmission gate 168 is connected to the clock input $\phi$ of toggle flip-flop 172. The output of inverter 170 is connected to the inverse clock input $\phi$ of toggle flip-flop 172. The Q1 output of flip-flop 172 is connected to a second input to AND gate 164 and to the $\phi$ input of toggle flip-flop 174. The Q1 output of flip-flop 172 is connected to the $\phi$ input to toggle flip-flop 174. Further, the Q2 output of flip-flop 174 is connected to the $\phi$ input to toggle flip-flop 176 and to a first input of NOR gate 180. The Q2 output of flip-flop 174 is connected to the $\phi$ input of toggle flip-flop 176 and an input of NAND gate 182. The Q3 output of flip-flop 176 is connected to the $\phi$ input of toggle flip-flop 178 and to a first input to NAND gate 182. The Q3 output of toggle flip-flop 176 is connected to the $\phi$ input of toggle flip-flop 178. The Q4 output of toggle flip-flop 178 is connected to a second input of NOR gate 180.

NOR gate 184 has three inputs, a first connected to the Q1 output of toggle flip-flop 172, a second input connected to the Q2 output of toggle flip-flop 174 and a third input connected to the Q4 output to toggle flip-flop 178. The output of NOR gate 184 is connected to a second input to NOR gate 162 and to the set input to toggle flip-flop 176.

Figures 5, 6:
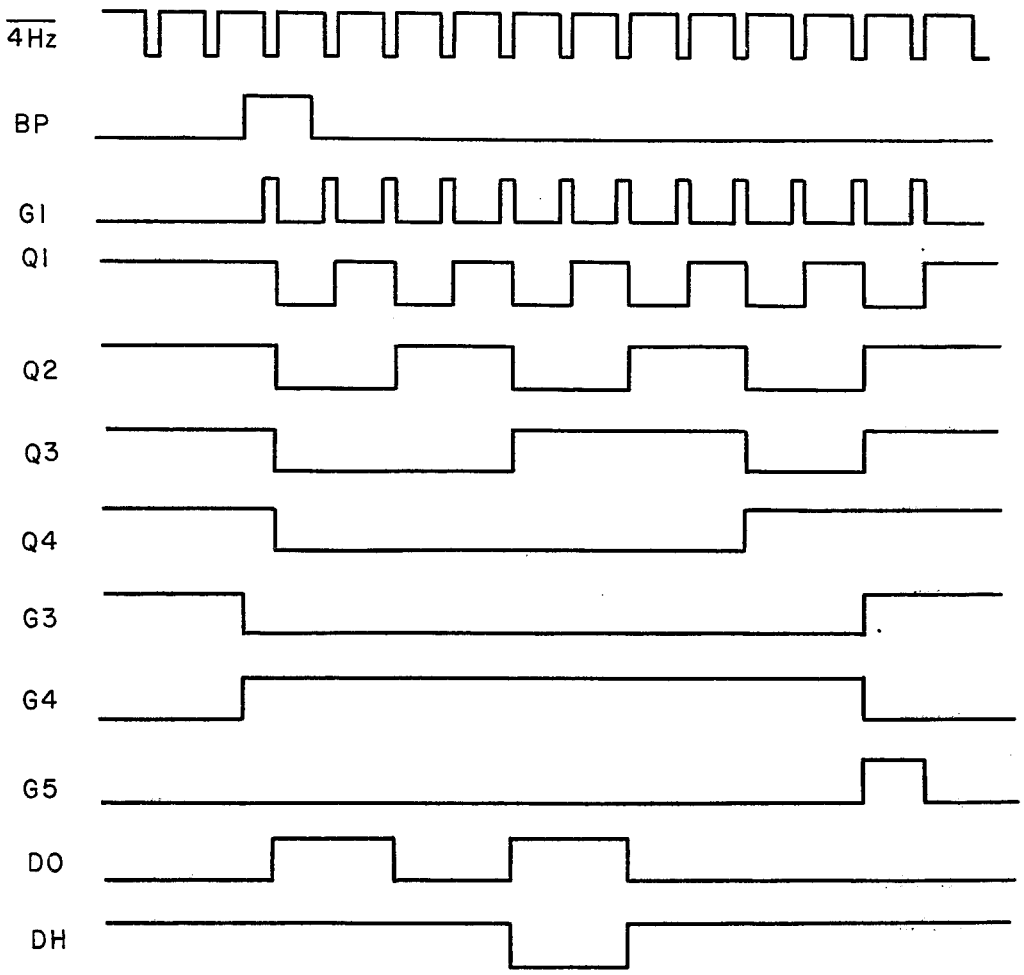
FIG. 5 is a timing diagram for the time sequencing circuit of FIG. 4.
FIG. 6 is a truth table showing the necessary conditions to display hours and minutes.

FIG. 5 is a timing diagram for the sequencing circuit of FIG. 4. It is employed to show the operation of said circuit. The normal condition of sequencing circuit 126 with push button control 50 unactivated is shown in FIG. 5, at time t0; the outputs of the four flip-flops Q1–Q4 and gate 160 are at a logic high binary level. Thus the negative 4-Hertz pulse is blocked by NOR gate 166 since the output of AND gate 164 is held at a binary high level, therefore nothing happens in the sequencing circuit until push button control 50 is depressed.

When push button control 50 is depressed, momentarily, at time t1, causing the push button input to NOR gate 160 to go to a binary high level, the output of NOR gate 160 changes states to a logic low level, which in turn causes the output of NOR gate 162 to go high. Since an input to AND gate 164 is now a low logic level, the output from said gate is at a low level. Since the output from AND gate 164 is an input to NOR gate 166, when the negative 4-Hertz pulse, which is the second input to NOR gate 166, goes low at time t2, the output from NOR gate 166 will go high.

The output of NOR gate 166 will stay high until its input from the negative 4-Hertz pulse goes high again at time t3. When the output from NOR gate 166 goes low at time t3, the output Q1 of flip-flop 172 will also go low, as well as the outputs Q2, Q3, and Q4 from flip-flops 174, 176, and 178, respectively. At time t3, the Q2 output of flip-flop 174, which is an input to NOR gate 180, is at a low logic level and said NOR gate's other input, the Q4 output of flip-flop 178, is also at a low logic level; therefore, the output from NOR gate 180, DO, is at a high level, as shown in FIG. 5. Also, the DH output from NAND gate 182 is at a high level at time t3, for its first input from the Q3 output of flip-flop 176 is at a low level. Since the DO and DH outputs are high from time *t*3 to time *t*7, the hours are displayed for one-half second on the two LED display elements.

At time *t*4, on the next falling edge of the 4-Hertz pulse, the output from NOR gate 166 will again go to a high logic level. At time *t*5, which is on the rising edge of the 4-Hertz pulse, the output from NOR gate 166 will go low, causing the output Q1 from flip-flop 172 to go high. At time *t*6, the output of NOR gate 166 again will go high. At time *t*7, the output of NOR gate 166 again will go low, causing the output Q1 from flip-flop 172 also to go low and causing the output Q2 from flip-flop 174 to go high. Finally, at time *t*7, the output of NOR gate 180, DO, will go low, since the Q2 input to NOR gate 180 is at a high level.

The truth table of FIG. 6 shows the prerequisite conditions for displaying hours and minutes. When both the DO and the DH outputs are at a high binary level, the hours are displayed, as can be seen in FIG. 5 between the time *t*3 and the time *t*7. Then, between time *t*7 and time *t*11, the DO output is low, thereby causing the display to be blank. Finally, between time *t*11 and time *t*15 the DO output is high and the DH output is low, causing the minutes information to be displayed.

At time *t*9 when the output of NOR gate 166 goes low, the Q1 output of flip-flop 172 goes high until the next falling edge from NOR gate 166, which occurs at time *t*11. At time *t*11, the Q2 output from flip-flop 174 goes low and the Q3 output from flip-flop 176 goes high. Also at time *t*11, the Q2 input to NOR gate 180 is low and the Q4 input to NOR gate 180 is also low; therefore, the output of NOR gate 180 goes to a high logic level. Since the Q3 input to NAND gate 182 is high and the Q2 input to NAND gate 182 is at a high logic level, the DH output from NAND gate 182 will be at a low level. As can be seen from the truth table of FIG. 6, the minutes information will be displayed when the DO output is high and the DH output is low; this condition exists between time *t*11 and time *t*15, as shown in the timing diagram of FIG. 5.

At time *t*15, the Q2 input to gate 180 is at a high logic level and the DO output goes low. As can be seen from the truth table of FIG. 6, when the DO output is low the display will be blank.

Finally, when the Q1, Q2 and Q4 inputs to NOR gate 184 are at a low level, *t*23, the output of said gate will go high, thereby causing toggle flip-flop 176 to set and gates 160 and 162 to change output levels. After a 4-Hertz pulse makes Q1 go high, the output from gate 184 goes low and the original condition of waiting for a signal from the activation of the push button control 50 exists. This condition is shown at time *t*25.

Although the device which has just been described appears to afford the greatest advantages for implementing the invention, it will be understood that various modifications can be made thereto without going beyond the scope of the invention, it being possible to replace certain elements by other elements capable of fulfilling the same technical functions therein.

What is claimed is:

1. A digital watch for displaying selectable horological information comprising:

first display means comprising a plurality of liquid crystal display devices;

second display means comprising two light emitting diode display devices, which sequentially display a first set of horological information followed by a second set of horological information when activated;

an electronic circuit for providing information to be selectively displayed on said displays, said electronic circuit comprising an oscillator, a frequency divider coupled to the output of said oscillator for producing a timing signal, and counters for receiving said timing signal and maintaining a plurality of sets of horological information;

first and second manually operable pushbutton controls connected between said counters and said displays;

means for causing said liquid crystal display to continuously display a first set of horological information when said first and second controls are unactuated and to display a second set of horological information on said liquid crystal display when said first control is actuated; and a timing circuit which causes said light emitting diode display to display said first set of horological information when said second control is activated.

2. A digital watch as recited in claim 1, wherein said means to display comprises switching means for connecting counters containing the first set of horological information to said first display when said first and second controls are unactivated and for connecting counters containing said second set of horological information to said first display when said first control is activated and for connecting said counters containing said first set of horological information to said second display when said second control is activated.

3. A digital watch as recited in claim 2, wherein said first display comprises segment liquid crystal display devices and a segment decoder is connected to said counters and said first display in parallel with said means to display.

4. A digital watch for displaying selectable horological information as recited in clam 1, wherein said timing circuit comprises a plurality of logic gates and a sequencing circuit which causes said LED display devices to display said first set of horological information when said second control is activated.

5. A digital watch as recited in claim 4, wherein said sequencing circuit comprises:

counting means connected to said oscillator for producing a predetermined timing sequence;

latch means for starting said timing sequence and completing it without interruption when activated by a push button; and resetting means connected between said counting means and said latch means for resetting said counting and latch means to the beginning of the timing sequence.

* * * * *

UNITED STATES PATENT OFFICE

CERTIFICATE OF CORRECTION

Patent No. 4,009,566 Dated March 1, 1977

Inventor(s) Ernest C. Ho

It is certified that error appears in the above-identified patent and that said Letters Patent are hereby corrected as shown below:

Column 1, line 13, "Art" instead of "ARt".

Column 2, line 25, "The" instead of "Th".

Column 2, line 42, "The" instead of "the".

Column 3, line 9, "oscillate" instead of "socillate".

Column 6, line 67, "multiplex" instead of "ultiplex".

Column 7, line 68, "The" instead of "Th".

Column 8, line 11, "$\bar{\phi}$" instead of "$\phi$".

Column 8, line 14, "$\bar{Q}1$" instead of "Q1".

Column 8, line 15, "$\bar{\phi}$" instead of "$\phi$".

Column 8, line 18, "$\bar{Q}2$" instead of "Q2".

Column 8, line 19, "$\bar{\phi}$" instead of "$\phi$".

UNITED STATES PATENT OFFICE

CERTIFICATE OF CORRECTION

Patent No. 4,009,566 Dated March 1, 1977

Inventor(s) Ernest C. Ho

It is certified that error appears in the above-identified patent and that said Letters Patent are hereby corrected as shown below:

Column 8, line 22, "$\bar{Q}3$" instead of "Q3".

Column 8, line 23, "$\bar{\phi}$" instead of "$\phi$".

Column 8, line 29, "$\bar{Q}2$" instead of "Q2"

Column 8, line 30, "$\bar{Q}4$" instead of "Q4".

Signed and Sealed this second Day of August 1977

[SEAL]

*Attest:*

RUTH C. MASON
*Attesting Officer*

C. MARSHALL DANN
*Commissioner of Patents and Trademarks*